US006302530B1

(12) United States Patent
Shimada et al.

(10) Patent No.: US 6,302,530 B1
(45) **Date of Patent: *Oct. 16, 2001**

(54) INK CARTRIDGE

(75) Inventors: Kazumichi Shimada; Hideki Oikawa; Hisashi Miyazawa; Yoshie Kumagai; Takao Kobayashi; Hisashi Koike, all of Nagano (JP)

(73) Assignee: Seiko Epson Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/881,644

(22) Filed: Jun. 24, 1997

(30) Foreign Application Priority Data

| | | |
|---|---|---|
| Jun. 25, 1996 | (JP) | 8-165009 |
| Dec. 25, 1996 | (JP) | 8-356296 |
| Dec. 27, 1996 | (JP) | 8-358766 |
| May 7, 1997 | (JP) | 9-132919 |

(51) Int. Cl.[7] ..... B41J 2/175

(52) U.S. Cl. ..... 347/86

(58) Field of Search ..... 347/85, 86, 87, 347/49

(56) References Cited

U.S. PATENT DOCUMENTS

| | | | |
|---|---|---|---|
| 4,543,590 | 9/1985 | Tazaki et al. | 347/43 |
| 4,806,032 | 2/1989 | Gragg et al. . | |
| 5,103,246 | 4/1992 | Dunn | 347/58 |
| 5,619,237 * | 4/1997 | Inoue et al. | 347/86 |

FOREIGN PATENT DOCUMENTS

| | | |
|---|---|---|
| 34 01 071 | 1/1984 | (DE) . |
| 195 34 613 | 9/1995 | (DE) . |
| 29711117-U1 * | 12/1997 | (DE) . |
| 0 278 764 | 8/1988 | (EP) . |
| 0 408 241 A2 | 1/1991 | (EP) . |
| 0 440 261 A2 | 8/1991 | (EP) . |
| 0 496 642 | 7/1992 | (EP) . |
| 0 623 471 | 4/1994 | (EP) . |

(List continued on next page.)

OTHER PUBLICATIONS

French Search Report FR 9901612, p1, Sep. 9, 1999.
French Search Report FR 9901611, pp 1–3, Sep. 8, 1999.
French Search Report FR 9901610, p1, Sep. 8, 1999.

*Primary Examiner*—N. Le
*Assistant Examiner*—Michael Nghiem
(74) *Attorney, Agent, or Firm*—Stroock & Stroock & Lavan LLP

(57) ABSTRACT

In accordance with the invention, in order to increase the volume of an ink cartridge containing color inks, to prevent the ink cartridge from being improperly mounted on a print head, to ensure that required rigidity of an ink cartridge, and to ensure the viscosities of different inks remain uniform, in an ink cartridge body, a plurality of ink chambers are arranged in at least two linear arrays, and ink supplying ports associated with the ink chambers are also arranged in two linear arrays, whereby the size of the ink cartridge can be reduced, and easy loading of the ink cartridge can be insured. Additionally, the ink supply ports may be arranged in a zig-zag, offset manner to allow for a further reduction in the size of the ink chambers and ink cartridge. The open outer ends of the ink supply ports are formed substantially flush with the bottom walls of the ink chambers. Therefore, the volumes of each of the ink chambers is increased. Further, at least one or the like is provided on the outside of the ink cartridge, to insure the strength and rigidity of the ink cartridge. Circuitous grooves are formed in the surface of a cover member so that the grooves communicating with ink chambers having a smaller volumes are longer than grooves communicating with ink chambers having larger volumes, thus insuring uniform viscosities of all of the inks.

14 Claims, 12 Drawing Sheets

FOREIGN PATENT DOCUMENTS

| | | |
|---|---|---|
| 06 23 471 A2 | 11/1994 | (EP) . |
| 0 627 323 | 12/1994 | (EP) . |
| 0 639 462 A | 2/1995 | (EP) . |
| 0 657 292 | 6/1995 | (EP) . |
| 0 666 177 | 8/1995 | (EP) . |
| 0 699 533 | 3/1996 | (EP) . |
| 0 703 083 A2 | 3/1996 | (EP) . |
| 0 773 109 A2 | 5/1997 | (EP) . |
| 0803 365 A3 | 10/1997 | (EP) . |
| 0 827 836 | 3/1998 | (EP) . |
| 0827 836 A1 | 3/1998 | (EP) . |
| 2 293 140 A | 3/1996 | (GB) . |
| 2 293 141 | 3/1996 | (GB) . |
| 2 293 142 | 3/1996 | (GB) . |
| 2 293 142 A | 3/1996 | (GB) . |
| 622 55151 | 11/1987 | (JP) . |
| 7-125262 | 5/1995 | (JP) . |
| WO90/00971 A1 | 2/1990 | (WO) . |
| WO96 34760 A | 7/1996 | (WO) . |

* cited by examiner

INK CARTRIDGE

BACKGROUND OF THE INVENTION

1. Field of the Invention

The invention relates generally to an ink cartridge and more particularly to an ink cartridge for use with a color ink jet printer.

2. Discussion of the Prior Art

An ink cartridge including a plurality of ink chambers formed integrally with each other is utilized to conduct a printing operation in a color printer. The color printer typically uses inks of yellow, magenta, cyan and black. Such an ink cartridge is particularly used in a color ink jet printer.

This type of ink cartridge, which uses inks of more than one color, typically including yellow, magenta, cyan and black, frequently employs a multi-level density printing method. In cartridges utilizing this multi-level density printing method, two types of ink of each color, including one light and one deep color, must be used. In designing an ink cartridge of a multi-level density printing type, if the ink chambers containing the inks are arranged in a line, there is a problem in that the size of the tank cannot be reduced beyond a certain point because of the size of the ink supply ports required for each ink chamber. Thus, each of the chambers cannot be reduced beyond a certain width. As a result, the ink cartridge is required to be constructed with extremely large length. Additionally, it is difficult to mount the ink cartridge on the carriage when it is so long. When loading such an ink cartridge, the ink cartridge may be shifted or skewed from its proper position, and in an extreme case, it is possible that the ink supply needles may be broken.

One way to increase the volumes of the ink chambers within the ink cartridge without increasing the overall size is to reduce the thickness of the partitioning walls between the ink chambers, for example. However, this approach may result in the problem of a reduced mechanical strength of the ink cartridge.

For any number of particular types of printer, the included carriages may be uniform in size, as a result of the manufacturing requirements and parts management requirements. Thus, the outside dimensions of various ink cartridges may be uniform, and thus it is possible that improper ink cartridges may be loaded onto a particular printer.

If the outside dimension of an ink cartridge is reduced, thus resulting in a reduction in the size of each the ink chambers, and an ink chamber has had a lot of ink used from it, or is an ink chamber having a small volume, even if a slight amount of ink evaporates from the ink chamber, the viscosity of the ink retained therein will change greatly, and thus will be different than the other inks.

Therefore, it would be beneficial to provide an ink cartridge for use with a color ink jet printer which overcomes the problem of the prior art.

SUMMARY OF THE INVENTION

Generally speaking, in accordance with the invention, an ink cartridge is provided with a plurality of ink supply ports communicating with a plurality of associated ink chambers. The chambers and ink supply ports are arrayed in at least two linear arrays on one surface of the ink cartridge. The ink supply ports of adjacent linear arrays may be provided in a zig-zag or offset manner. With this novel and unique construction, the ink chambers may be reduced in size independent of the size of the ink supply ports.

In an ink cartridge including a plurality of small and large ink chambers, constructed in accordance with another aspect of the invention, air passages are formed in a cover member for covering the open end of the ink cartridge. The air passages communicate at first ends thereof with the plurality of large and small ink chambers and are placed in fluid communication with ambient air at the second ends thereof. The air passages communicating with the smaller of the plurality of ink chambers have a larger resistance to the flow of fluid than the air passages communicating with the larger of the plurality of ink chambers. With this novel and unique construction, the viscosities of inks in the various sized ink chambers may be kept uniform irrespective of the amount of ink contained in the chambers, thus compensating for evaporating and flow rates.

In an ink cartridge including a plurality of ink chambers, constructed in accordance with a further aspect of the invention, a reinforcing rib is formed on the ink cartridge. The lengthwise dimension of the reinforcing rib is formed larger than the widthwise dimension. A second reinforcing rib is also positioned protruding from each side wall of the ink cartridge while extending there along. Thus, the required mechanical strength of the ink cartridge can be insured, even if the thickness of the walls are reduced.

In an ink cartridge constructed in accordance with an additional aspect of the invention, at least one groove for preventing the incorrect mounting of the ink tank is formed in one of the side walls of ink cartridge. In each different type of ink cartridge the position of the groove is changed. Since each printer can be designed to accept an ink tank having only one particular groove, this unique construction eliminates the possibility of loading a wrong ink cartridge onto a printer.

Accordingly, it is an object of the invention is to provide a novel ink cartridge which contains the proper amount of each color ink in proportion to the amount of ink that is used in an ink cartridge having a standard exterior shape.

Another object of the invention is to provide a novel ink cartridge which is satisfactorily rigid without reducing the volumes of the ink chambers, and which cannot be improperly loaded onto a printer.

Yet another object of the invention is to provide a novel ink cartridge which can retain the uniformity of viscosities of inks contained therein.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings (s), in which:

FIG. 2(*b*) is a bottom plan view showing the bottom of an ink cartridge constructed in accordance with an additional embodiment of the invention;

FIG. 3(*b*) is a bottom plan view showing the bottom of an ink cartridge constructed in accordance with an additional embodiment of the invention;

FIG. 4(*b*) is a bottom plan view showing the bottom of an ink cartridge constructed in accordance with an additional embodiment of the invention;

FIG. 4(*c*) is a bottom plan view showing the bottom of an ink cartridge constructed in accordance an additional embodiment of the invention;

FIG. 5(*b*) is a cross-sectional view of the ink cartridge of FIG. 5(*a*);

FIG. 6(*b*) is a cross-sectional view of a comer of the ink cartridge shown in FIG. 5(*a*);

FIG. 7(*b*) is a side elevational view of the ink cartridge as shown in FIG. 5(*a*);

FIG. 8(*b*) is a top plan view of the cover of the ink cartridge shown in FIG. 5(*a*);

FIG. 9(*b*) is a cross-sectional view of a second cover groove constructed in accordance with the invention, FIG. 10(*a*) is a cross-sectional view of an ink cartridge constructed in accordance with another embodiment of the invention;

FIG. 11(*b*) is a side elevational view of the ink cartridge shown in FIG. 10(*a*);

FIG. 12(*b*) is a top plan view of the cover of the ink cartridge shown in FIG. 10(*a*).

DETAILED DESCRIPTION OF THE PREFERRED EMBODIMENTS

The preferred embodiments of the present invention will be described with reference to the accompanying drawings.

Figure 1:
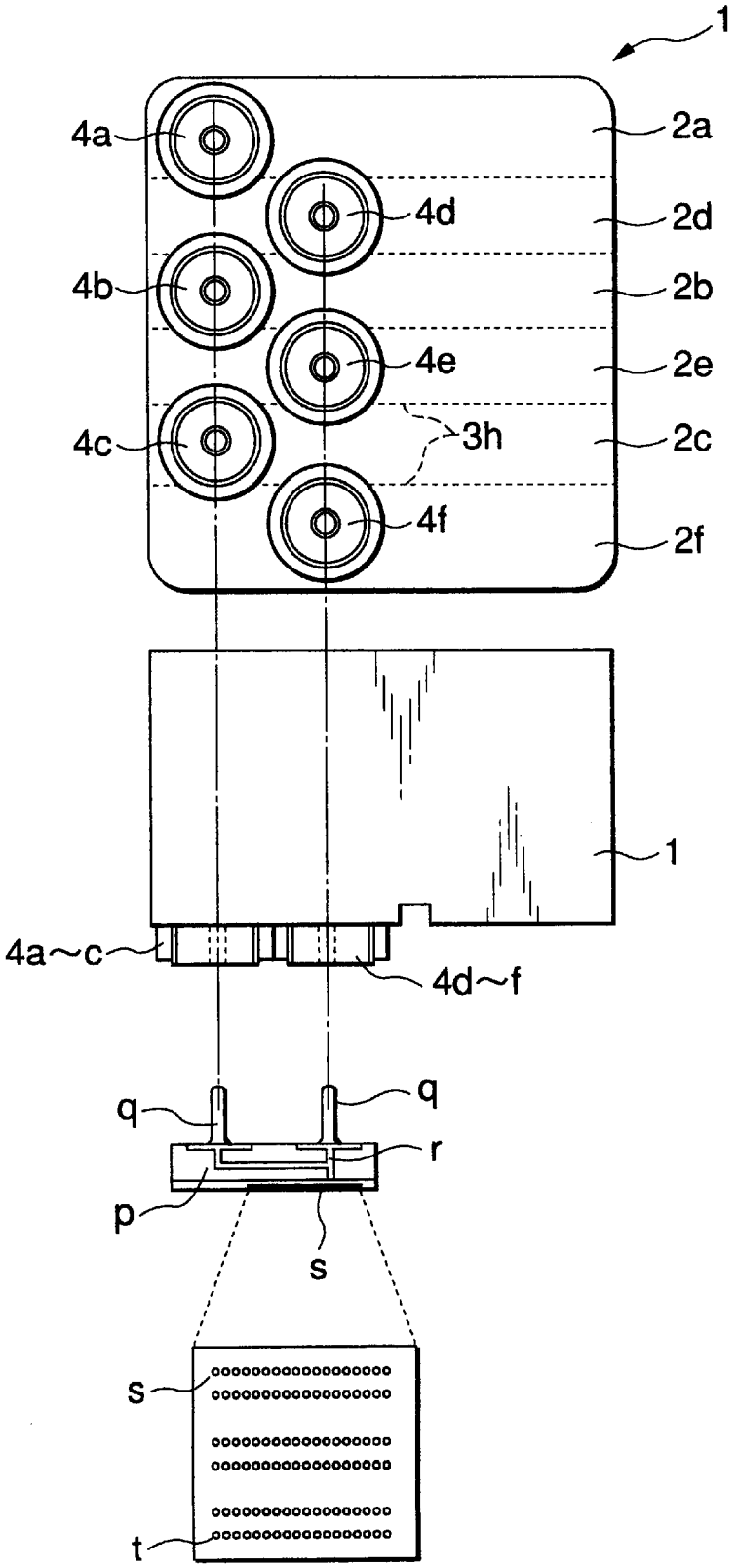
FIG. 1 is a bottom plan view of an ink cartridge constructed in accordance with an embodiment of the invention and a side elevation view of the ink cartridge constructed in accordance with the invention depicting the relationship of the ink cartridge to a print head.

FIG. 1 depicts an ink cartridge constructed in accordance with an embodiment of the invention in which the ink cartridge is used in an ink jet printing device of the multi-level density printing type. An ink cartridge body, indicated generally as 1, includes ink chambers 2*a*–2*e* for containing inks of magenta, cyan and yellow, and inks of light magenta and cyan, and an ink chamber 2*f* having a larger capacity than the capacity of ink chambers 2*a*–2*e* for containing black ink. These ink chambers are partitioned by partitioning walls 3*h* within ink cartridge body 1.

Associated ink supply ports 4*a* to 4*f* are formed in a bottom wall of ink cartridge body 1 and communicate with respective ink chambers 2*a* to 2*f*. Ink supply ports 4*a*–4*f* are disposed closer to one side of ink cartridge body 1. Ink supply ports 4*a* to 4*f* are arranged in a zig-zag or off-set fashion, as is shown in FIG. 1. Because of the zig-zag or off-set arrangement of ink supply ports 4*a*–4*f*, neither ink chambers 2*a*–2*f* nor ink supply ports 4*a*–4*f* interfere with each other when ink chambers 2*a* to 2*f* are formed as thin as possible, so that chambers 2*a*–2*f* may be made thinner than the diameter of each of ink supply ports 4*a*–4*f*.

As shown in FIG. 1 ink cartridge body 1 is adapted to be mounted on a printhead p, and ink supply needle q is injected into each ink supply port 4*a* to 4*f*. Then, ink from each of ink chambers 2*a* to 2*f* are supplied to associated nozzles t of a nozzle plate s by way of associated ink passages r.

In this embodiment, ink chambers 2*a* to 2*d* may be formed with a width being as thin as possible irrespective of the outside diameters of ink supply ports 4*a* to 4*d*. Therefore, the width of ink cartridge body 1 may be reduced in size corresponding to the cumulative reduction to the thickness of these chambers.

Figure 2A:
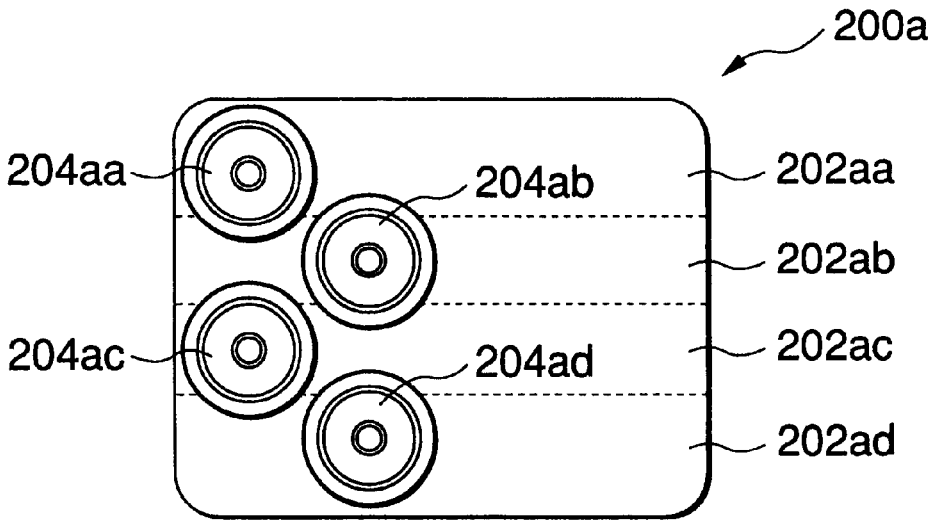
FIG. 2(*a*) is a bottom plan view showing the bottom of an ink cartridge constructed in accordance with an additional embodiment of the invention.
Figure 2B:
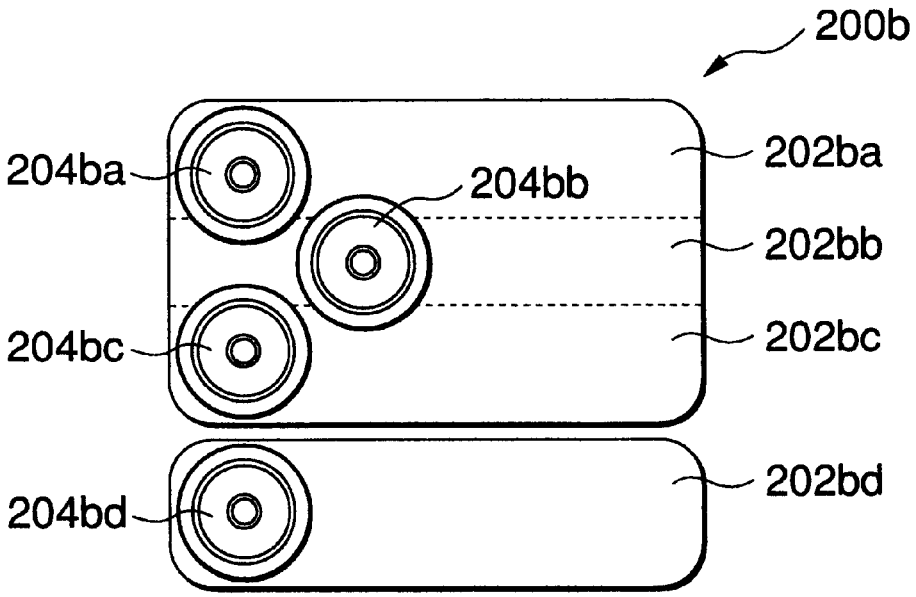

FIGS. 2(*a*) and 2(*b*) depict ink cartridges 200*a* and 200*b* using inks of four color inks, which in a preferred embodiment include cyan, magenta, yellow and black, which are adapted for use in a full color printer. As in ink cartridge 1, ink cartridge 200*a* includes a plurality of chambers 202*aa*–202*ad* communicating with offset supply ports 204*aa*–204*ad* respectively. In ink cartridge 200*b* shown in FIG. 2(*b*), ink chamber 202*bd* containing black ink is formed separately from the other chambers. As in the cartridge of the first embodiment, the ink supply ports 204*ba*–204*bc* of ink cartridge 200*b* are arranged in a zig-zag, off-set fashion. Therefore, the overall size of ink cartridges 200*a* or 200*b* may be reduced without any reduction required in the outside diameters of ink supply ports 204*aa*–204*ad* or 204*ba*–204*bc*.

Figure 3A:
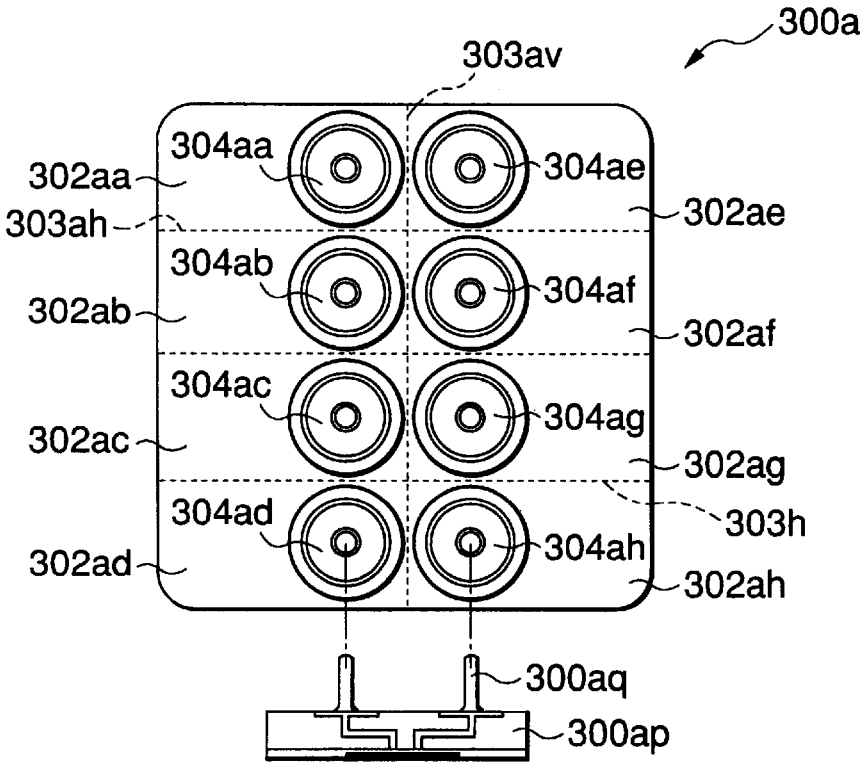
FIG. 3(*a*) is a bottom plan view showing the bottom of an ink cartridge constructed in accordance with an additional embodiment of the invention and depicts the relationship of the ink cartridge to ink supply needles.
Figure 3B:
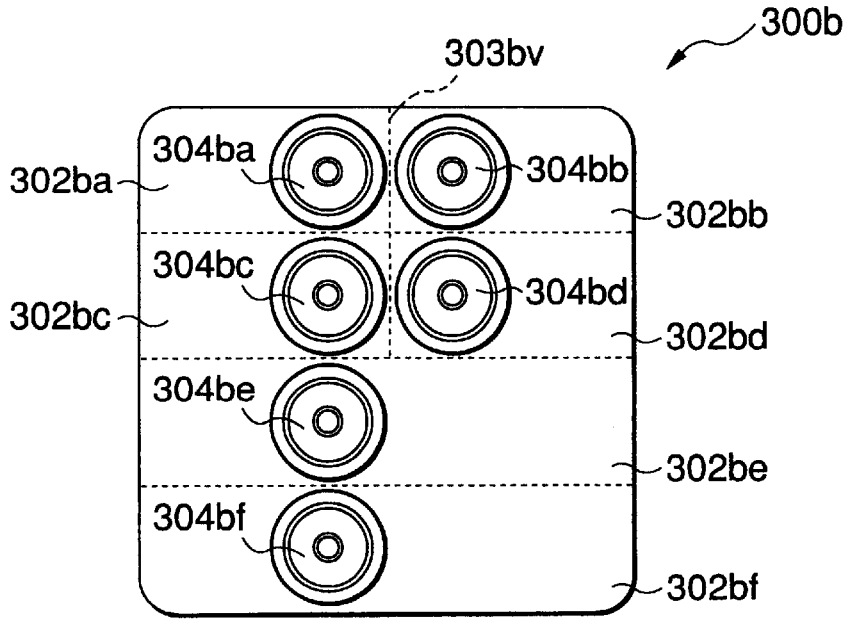

FIGS. 3(*a*) and 3(*b*) depict another embodiment of ink cartridges used in an ink jet printing device of the multi-level density printing type constructed in accordance with the invention and generally indicated as 300*a*, 300*b*.

Ink cartridge body 300*a* shown in FIG. 3(*a*) is provided with a total of eight ink chambers 302*aa*–302*ah* which in a preferred embodiment contain inks of four colors, cyan, magenta, yellow and black, both light and deep versions for a total of eight different inks. Ink chambers 302*aa* to 302*ah* are arranged such that they are partitioned at least in part by one long partitioning wall 303*av*, which forms one wall of each ink chamber, and a plurality of short partitioning walls 303*ah* intersection wall 303*av* to form individual chambers 302*aa*–302*ah*. These ink chambers 302*aa*–302*ah* are arranged such that four chambers are arranged on one side of long partitioning wall 303*av*, and the remaining four chambers are arranged on the other side thereof. Ink supply port 304*aa*–304*ah*, which communicate with the ink chambers 302*aa* to 202*ah* respectively, are provided in a central portion on the bottom of cartridge body 300*a*. Four ink supply ports 304*aa*–304*ad* are arranged on one side and along long partitioning wall 303*av*, corresponding to a linear array of ink supply needles q, while the remaining four ink supply ports 304*a* e-304*a* g are arranged on the other side and along long partitioning wall 303*av*, corresponding to another linear array of needles q. Since ink chambers 302*aa* to 302*ah* are thus divided into two groups, the size of ink cartridge body 300*a* can be reduced without substantially changing the size of the ink chambers 302*aa*–302*ah*. Further, the ink cartridge may be loaded to the printhead with less of a likelihood of inclination of the cartridge and improper loading, thus ensuring easy and reliable loading of the cartridge.

In the above embodiment, the volumes of the ink chambers 302*aa*–302*ah* are equal to one another. In the embodiment shown in FIG. 3(*b*), the ink chambers may be arranged depending on the amount of ink in a particular ink chamber that will be used for a particular use, such that ink chambers of large and small volumes are separately disposed within an ink cartridge 300*b*. For example, as shown in FIG. 3(*b*), ink chambers having larger volumes are disposed beyond long partition wall 303*bv* which does not extend entirely along ink cartridge 300*b* and those having smaller volumes are disposed along wall 303*bv*. In the case of FIG. 3(*b*), ink chambers 302*ba*–302*bd* contain ink of light and deep cyan and magenta are separately disposed on the first and second sides of long partitioning wall 303*bv*. Ink chambers 302*be* and 202*bf*, which contain inks of yellow and black and which are used a lot, unlike ink chambers 202*ba*–202*bd*, are disposed beyond wall 303*bv* and are not divided thereby. Ink supply ports 304*be* and 304*bf* corresponding to ink chambers 302*be* and 302*bf*, are linearly arranged in alignment with ink supply ports 304*ba* and 304*bc*.

Figure 4A:
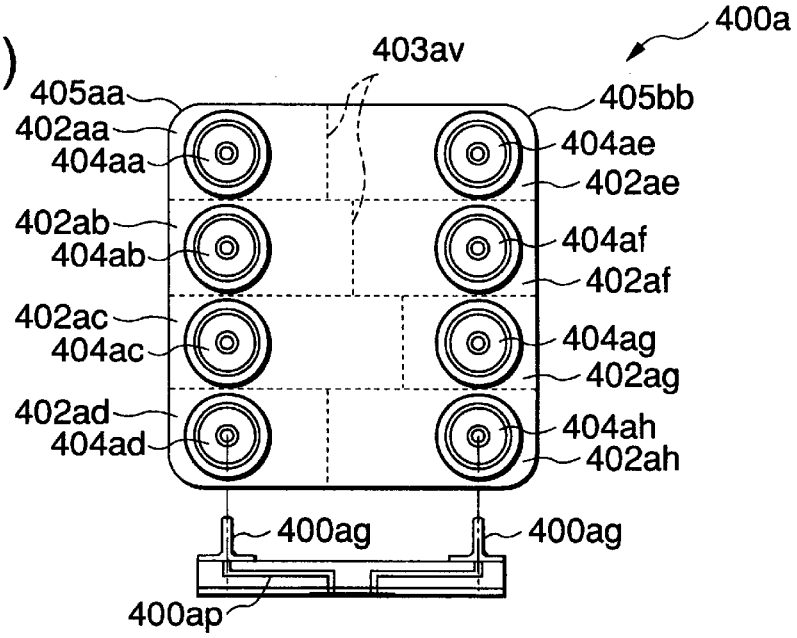
FIG. 4(*a*) is a bottom plan view showing the bottom of an ink cartridge constructed in accordance with an additional embodiment of the invention and depicts the relationship of the ink cartridge to ink supply needles.
Figure 4B:
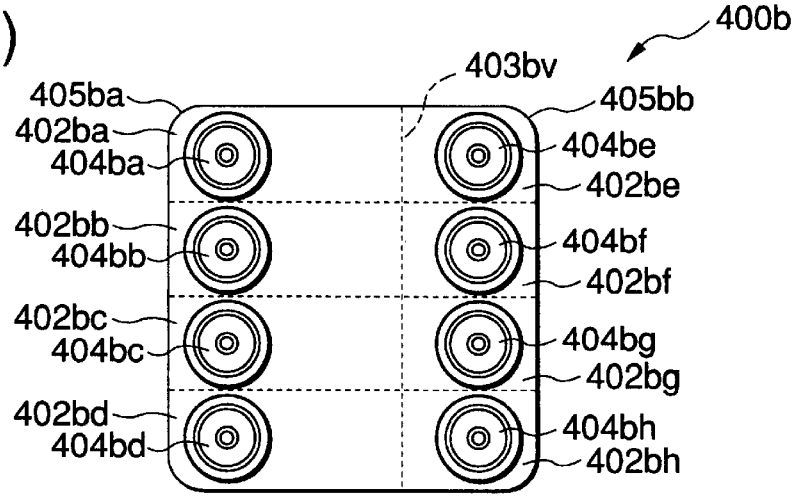
Figure 4C:
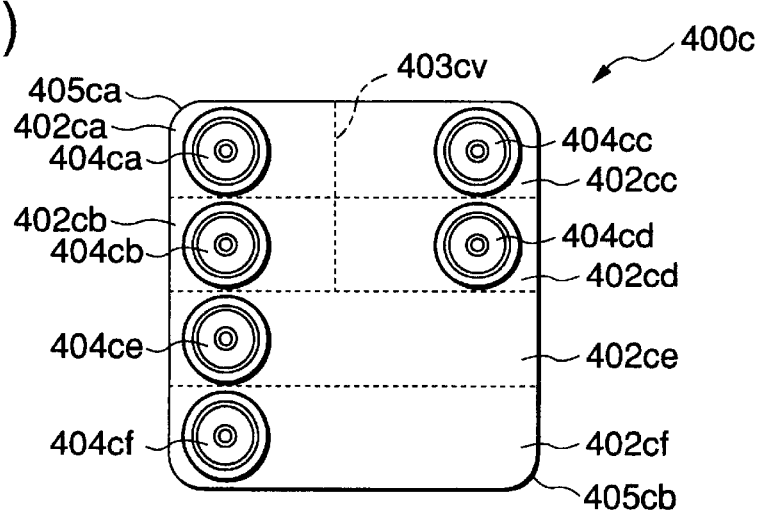

Additional embodiments constructed in accordance with the invention separately are shown in FIGS. 4(*a*)–4(*c*) respectively. In the embodiment depicted in FIG. 4(*a*), eight ink chambers 402*aa*–402*ah*, respectively, are arranged in two linear arrays; one is located adjacent a first side of the bottom of an ink cartridge 400*a* and the other is located adjacent a second side thereof. In ink cartridge 400*a*, the linear arrays of ink supply ports 404*aa*–404*ah* are aligned with linear arrays of ink supplying needles 400*aq*, respectively, and are positioned adjacent first and second sides 405*aa* and 405*ab* of ink tank 400*a*. In ink cartridge 400*a*, the volumes of the ink chambers 402*aa*–402*ah* may be varied in accordance with the amount of ink required depending on the kind of image to be printed by a printer employing the cartridge. Thus, an image requiring control of the granularity in highlight, for example, a landscape, a portrait and photograph, or alternatively an image mainly containing graphs and text, or the like, may be accommodated by merely horizontally shifting partitioning walls 403*av* between the appropriate ink chambers 402*aa*–402*ah*. In other words, partitioning walls 403*av* need not be linearly aligned to form a single long wall as in ink cartridge 300*a* or 300*b*.

In ink cartridge 400*b* of FIG. 4(*b*), eight chambers are also provided with the ink supply ports being arranged on only the sides of the bottom, the primary difference being the use of a single wall 403 along the length of the ink cartridge to form the chambers. Ink supply ports 404*ba*–404*bh* are arranged in two linear arrays located adjacent first and second sides 405*ba* and 405*bb* of the bottom of the ink cartridge 400*b*, as in ink cartridge 400*a*. In ink cartridge 400*b*, a single partitioning wall 403*bv* divides the ink chambers at a position closer to side 405*bb* of the bottom of ink cartridge 400*b* into two groups of ink chambers. The first group including ink chambers 404*ba*–404*bd* having larger volumes, and the second group including ink chambers 404*be*–404*bh* having smaller volumes.

In ink chamber 400*c* shown in FIG. 4(*c*), only six chambers are formed to accommodate larger chambers is provided. Ink supply ports 404*ca*–404*cf* are also positioned in two linear arrays located adjacent first and second sides 405*ca* and 405*cb* of the bottom of ink cartridge 400*c*. In this case, the linear array adjacent side 405*ca* consists of ink supply ports 404*ca*, 404*cb*, 404*ce* and 4*cf*, and the linear array adjacent side 405*cb* consists of only two ink supply ports 404*cc* and 404*cd*. Ink chambers 402*ce* and 40*cf*, which in a preferred embodiment contain inks of yellow and black, are disposed beyond a partitioning wall 403*cv* and are not partitioned by the partitioning wall 403*cv*, so that these chambers have larger volumes.

In the ink cartridges thus far described, ink supply ports are disposed in two linear arrays. The number of the linear arrays of ink supply ports utilized may be three or larger if the configuration and size of the ink cartridge require an increase of the number of arrays. Additionally, in each of the embodiments, it is possible to provide the ink supply ports in a zig-zag, off-set arrangement, as shown in FIG. 2(*a*), to further conserve space and allow the ink chambers to be even thinner.

Figure 5A:
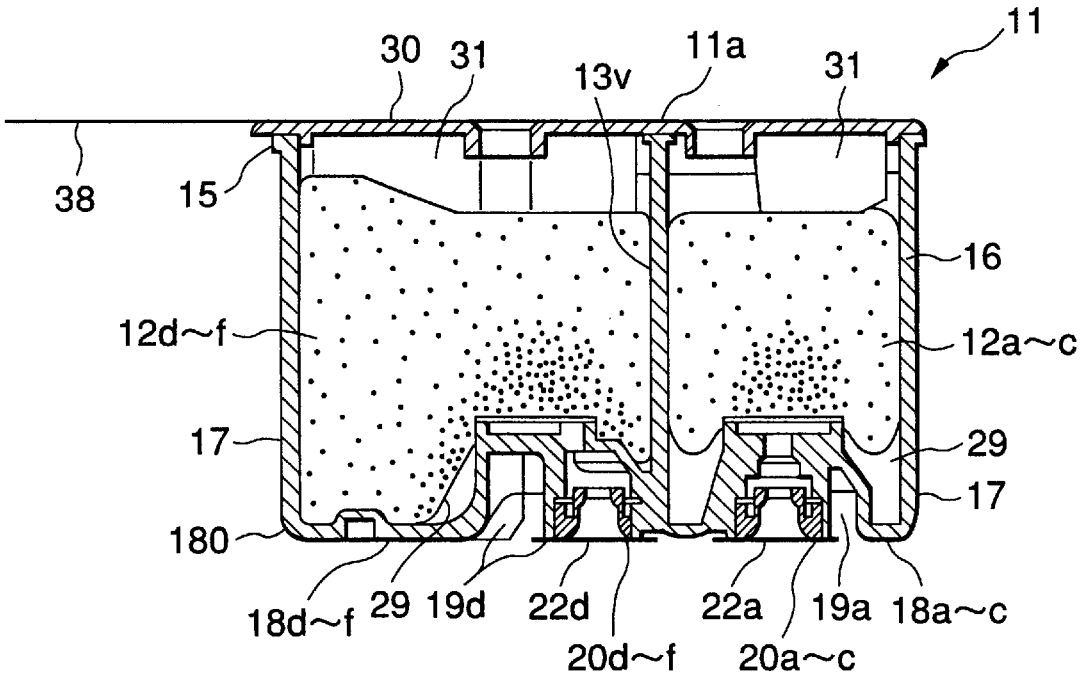
FIG. 5(*a*) is a cross-sectional view of an ink cartridge constructed in accordance with an additional embodiment of the invention.
Figure 5B:
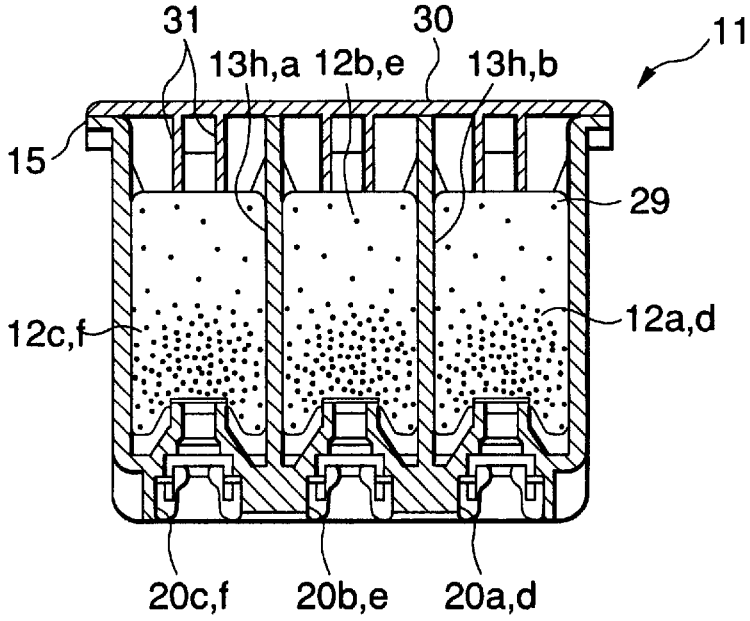

The embodiments constructed in accordance with the cartridges illustrated in FIGS. 5(*a*)–7(*b*) are constructed such that a plurality of ink chambers of the largest possible total volumes are formed in a fixed inner space of an ink cartridge without decreasing the strength of the ink cartridge and, while insuring that the viscosities of the inks remain uniform.

An ink cartridge body, indicated generally as 11 and constructed in accordance with an additional embodiment of the invention, is shown in FIGS. 5(*a*)–7(*b*). Ink cartridge body 11 is formed of polypropylene in a preferred embodiment, which is low in permeability to vapor but is relatively weak in strength. Ink cartridge body 11 takes the form of a cuboid so as to contain the greatest amount of ink possible. The inner space of ink cartridge 11 is partitioned by one vertical partitioning wall 13*v*, and two horizontal partitioning walls 13*ha* and 13*hb* to form six ink chambers 12*a* to 12*f* arrayed in a matrix of three columns and two rows. Ink chambers 12*a* to 12*c*, which have a smaller volume (referred to as smaller ink chambers) in a preferred embodiment contain inks of deep magenta and cyan, and black ink, while ink chambers 12*d* to 12*f*, which have a larger volume (referred to as large ink chambers), in a preferred embodiment contains inks of light magenta and cyan, and ink of yellow for producing a halftone.

Figure 6A:
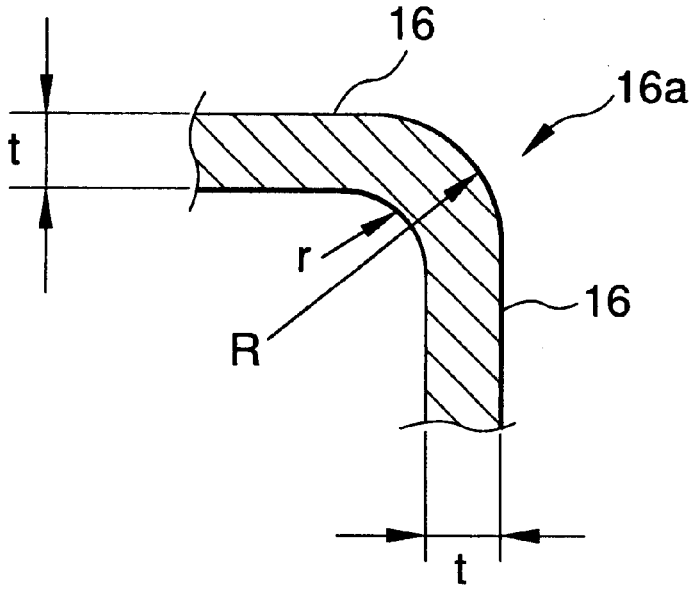
FIG. 6(*a*) is a cross sectional view of a corner of the ink cartridge shown in FIG. 5(*a*)
Figure 6B:
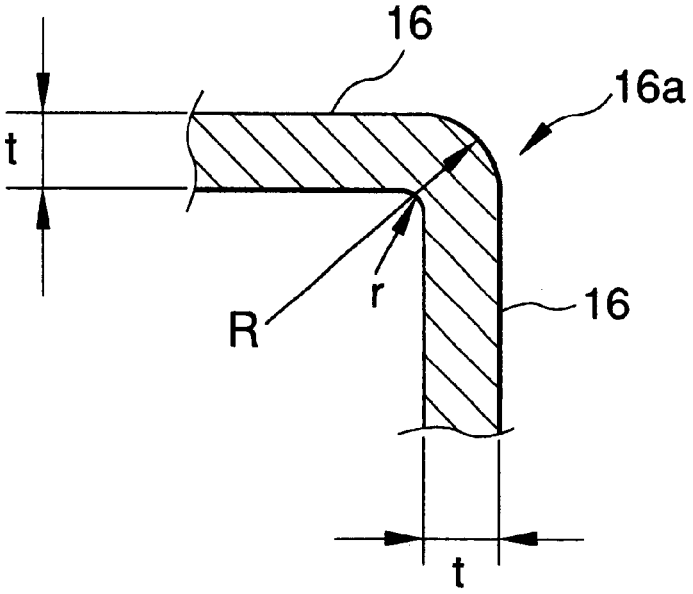

A reinforcing rib 15 extends outwardly from the peripheral edge of a top open end 11*a* of ink cartridge body 11. The lengthwise dimension of rib 15 is larger than the widthwise dimension thereof. A second rib 17 for receiving a sensor and preventing a deformation of ink cartridge body 11 protrudes from each side wall 16 of ink cartridge body 11 and is formed as an elongated member along each side wall 16. As shown in FIGS. 6(*a*) and 6(*b*), each comer 16*a* connecting adjacent side walls of the cartridge body 11 is designed such that the thickness of the comer is uniform over the range from open end 11*a* (FIG. 6(*a*)) of the cartridge body to bottom 180 (FIG. 6(*b*)), and the inside and outside radii r and R are gradually reduced from open end 11*a* of cartridge body 11 to the bottom 180.

Bottom walls 18 of these chambers 12*a* to 12*f* are formed flush with the bottom surface 180 of in cartridge body 11 so as to allow for the greatest volumes of the ink chambers. Positioning grooves 190*a* and 19*d*, which are respectively provided adjacent the group of smaller ink chambers 12*a* to 12*c* and the group of larger ink chambers 12*d* to 12*f*, are formed in the bottom walls 18 of ink chambers 12*a*–12*f*. Within positioning grooves 190*a* and 190*b*, tubularly shaped ink supply ports 20*a*–20*f*, are positioned so as to be formed continuous to and flush with the bottom walls 18*a*–18*f* of the ink chambers 12*a* to 12*f*. The openings of ink supply ports 20*a* and 20*f* are closed with tapes 22*a*–22*f*, the openings being essentially flush with bottom walls 18*a*–18*f* of the ink chambers 22*a*–22*f*.

Figure 7A:
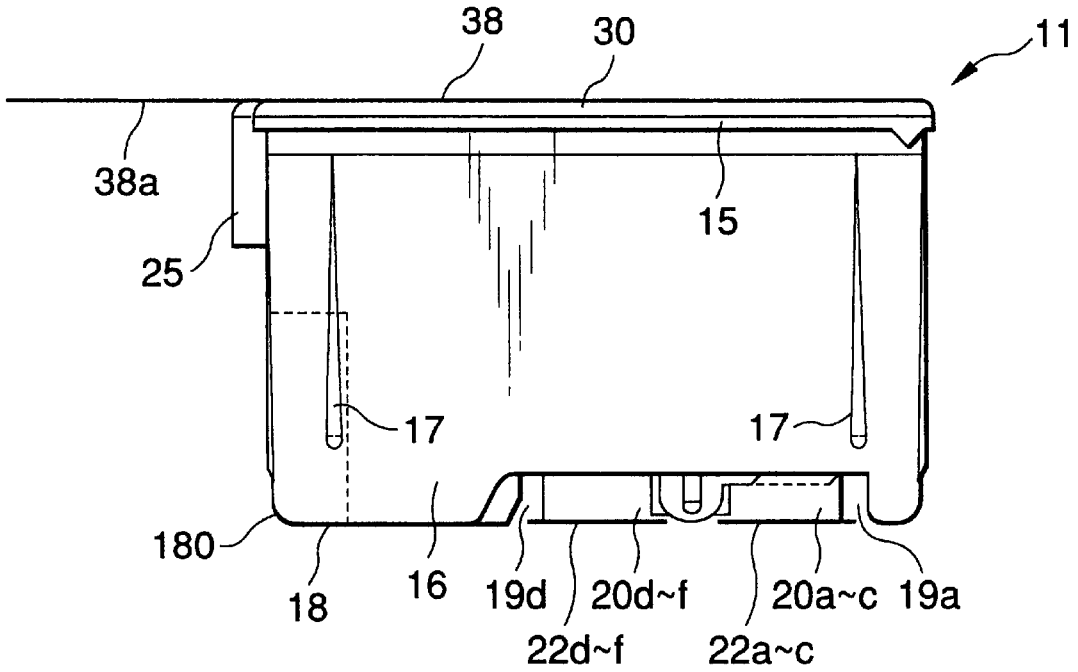
FIG. 7(*a*) is a side elevational view of the ink cartridge as shown in FIG. 5(*a*)
Figure 7B:
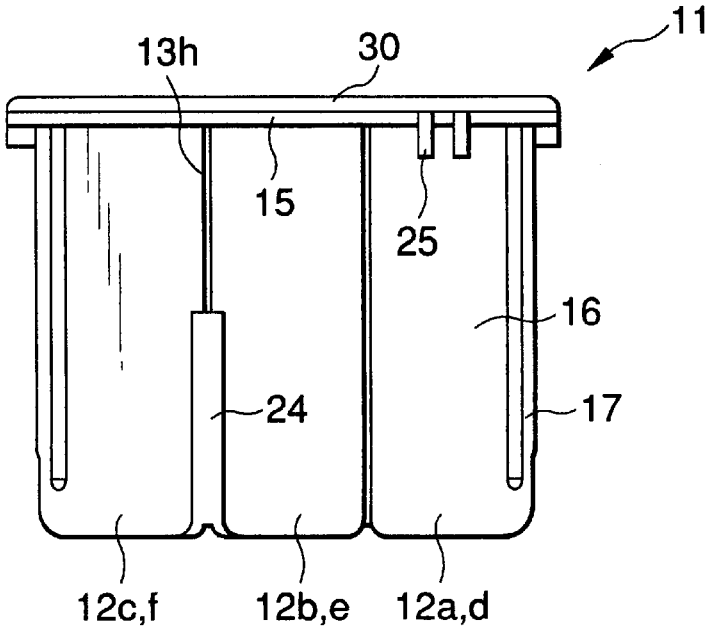

As is further shown in FIG. 7(*b*), a groove 24 is provided for preventing the cartridge from being improperly attached to a printhead. Groove 24 is formed in one of the lengthwise side walls and extends parallel with, and along a partitioning wall 13*h*, defining the adjacent ink chambers 12*e* and 12*f* by way of example. A raised portion 25 is formed on the upper portion of the side wall 16 to further prevent improper attachment of the ink cartridge to a printhead. The carriage (not shown) is provided with an engaging protrusion. When attaching cartridge 11 to the printhead, the engaging protrusion of the carriage is coupled to the groove 24 of the cartridge to insure correct attachment of cartridge 11 to the printhead.

In the present embodiment, groove 24 is formed so as to extend parrallel with and along partitioning wall 13*h* between ink chamber 12*e* and ink chamber 12*f*. The position of the groove 24 may be changed for each different type ink cartridge, or a plurality of grooves 24 may be used. In this case, proper combinations of the groove position and the number of grooves may be used for identifying different types of ink cartridges, whereby erroneous attachments of improper ink cartridges in a printer are prevented. Raised portion 25 provided in the upper portion of the side wall 16 may also be positioned slightly differently to further identify particular types of ink cartridges, and aid in preventing the use of an incorrect ink cartridge in a printer.

In FIG. 7(*a*) in addition to FIGS. 5(*a*) and 5(*b*), a cover member 30 is provided for closing open end 11*a* of cartridge body 11. Cover member 30 has the same planar shape as the outer edge of reinforcing rib 15 provided on open end 11*a* of the cartridge body 11. Vertical ribs 31 are provided on the inner surface of cover member 30 and in each ink chamber for pressing porous members 29 contained in each of ink chambers 12*a* to 12*f*. Each vertical rib 31 extends further into the associated ink chamber adjacent associated ink supply ports 20*a*–20*f* than in the other portions of the associated ink chamber. Vertical ribs 31 cooperate with ink supply ports 20*a*–20*f* to highly compress porous members 29 therebetween. As a result, the size of the pores in porous members are reduced, to generate a strong capillary action in the vicinity of this compression. By this strong generated capillary action, ink which is uniformly absorbed in porous member 29 can be directed to the associated ink supply ports 20*a*–20*f* as the amount of ink remaining in the ink chamber decreases.

Figure 8A:
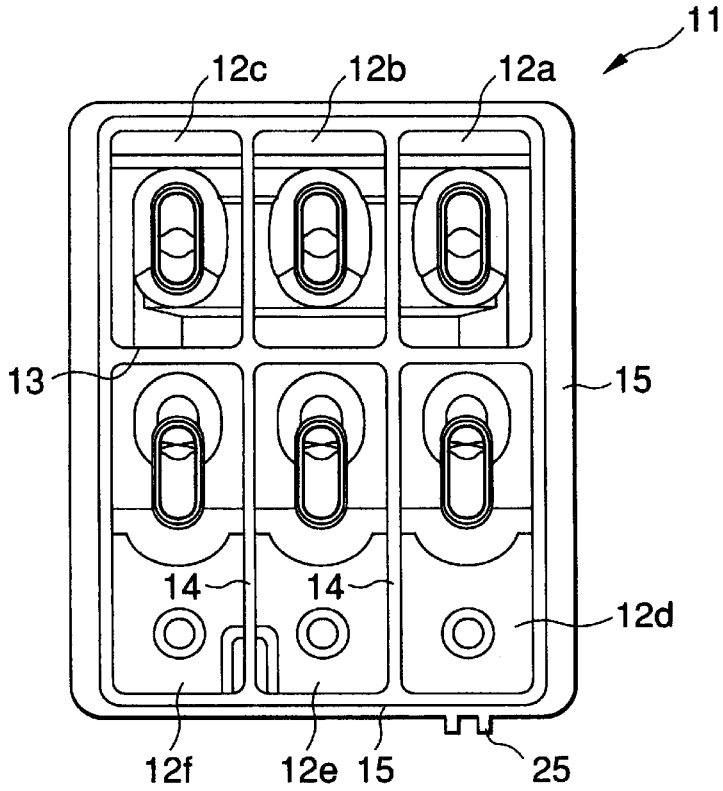
FIG. 8(*a*) is a bottom plan view of the ink cartridge shown in FIG. 5(*a*)
Figure 8B:
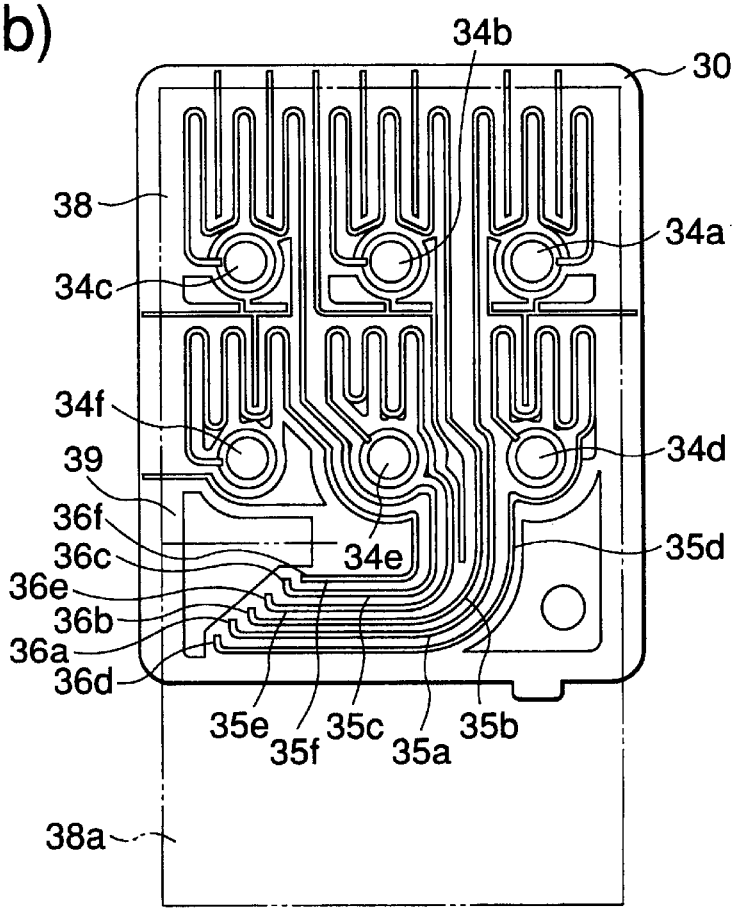

As shown in FIG. 8(*b*), through-holes 34*a* to 34*f* for ink filling and air venting are formed in cover member 30 covering open end 11*a* of ink cartridge body 11. One throughhole 34*a*–34*f* is associated with a respective one of ink chambers 12*a* to 12*d*. Circuitous grooves 35*a*–35*f* are formed on the inner surface of cover member 30 coupling through-holes 34*a* to 34*f* to a plurality of exit through-holes 36*a* to 36*f*. Circuitous grooves 35*a* to 35*c* which communicate with smaller ink chambers 12*a* to 12*c*, are much longer than circuitous grooves 35*d* to 35*f*, which communicate with larger ink chambers 12*d* to 12*f*. By so selecting the length of the circuitous grooves, when ink chambers 12*a* to 12*f* are opened to the air by stripping off a film 38, the amount of ink evaporated from small ink chambers 12*a* to 12*c* will be small as compared to the amount of ink evaporated from large ink chambers 12*d* to 12*f*.

Figure 9A:
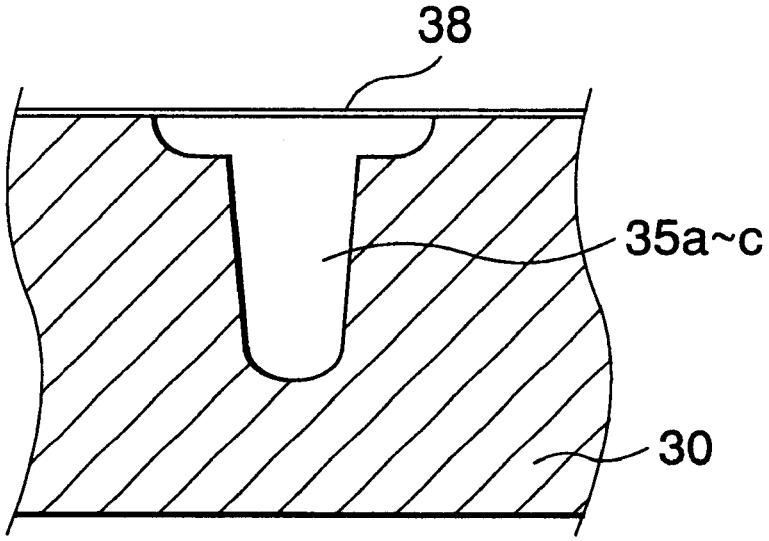
FIG. 9(*a*) is a cross-sectional view of a cover groove constructed in accordance with the invention.
Figure 9B:
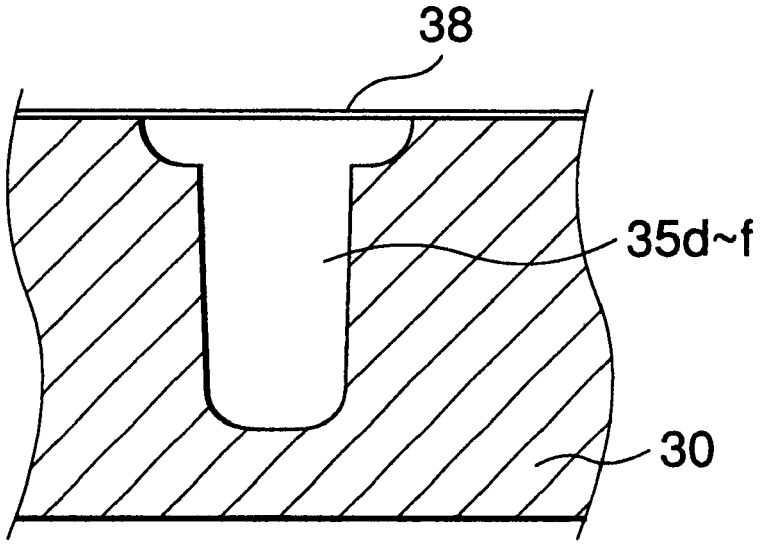

As shown in FIGS. 9(*a*) and 9(*b*), each of circuitous grooves 35*a* to 35*c* communicating with smaller ink chambers 12*a* to 12*c* has a smaller cross-sectional area than that of each of circuitous grooves 35*d* to 35*f* communicating with larger ink chambers 12*d* to 12*f*, whereby resistance to fluid flow in circuitous grooves 35*a* to 35*c* is greater than the resistance in circuitous grooves 35*d*–35*f*.

Exit through-holes 36*a* to 36*f* at which circuitous grooves 35*a*–35*f* terminate are arrayed so as to form an angled array of exit through-holes, the vertex of which is located at the front of the array when viewed in the direction of stripping the film. Thus, a portion 38*a* of film 38 can easily be stripped from the cartridge. Film 38 for sealingly covering circuitous grooves 35 is formed such that one edge of film 38 is equal to the width of cover member 30, and the other edge thereof is longer than the length of cover member 30. Therefore, film 38 may readily be formed by merely cutting a strip from a reel of material of the appropriate width. One side of film 38 is cut out to form a cutout 39 defining portion 38*a* so as to allow exit through-holes 36*a*–36*f* to be exposed to ambient air when portion 38*a* of film 38 at cutout 39 is removed.

In a preferred embodiment, ink cartridge body 11 is constructed of polypropylene which has a low permeability to vapor, but which is flexible and weak in strength. However, cartridge body 11 is substantially uniformly reinforced in both the lengthwise and widthwise directions by reinforcing rib 15, which is positioned on the peripheral edge of open end 11*a* of ink cartridge 11 and is shaped such that the lengthwise dimension of rib 15 is larger than the widthwise dimension thereof. Ink cartridge body 11 is reinforced also in the vertical direction by a plurality of ribs 17, which are provided vertically along each side wall 16. The inside and outside radii r and R are gradually reduced from open end 11*a* cartridge body 11 to bottom 180 thereof. Therefore, the ink chambers may be formed with a width as thin as possible, thereby increasing the volumes of the ink chambers. With the low vapor permeability of the polypropylene, inks can maintain their quality for an extended period of time.

Groove 24 for avoiding improper mounting of an ink tank is provided on side wall 16 of ink cartridge body 11 so that it extends to the bottom surface 180 of ink chamber 11 and extends along the partitioning wall 13*h*. Groove 24 cooperates with an engaging protrusion formed on the carriage to prevent ink cartridge 11 from being attached to an incorrect printhead, or to prevent ink cartridge 11 from being improperly attached to the correct printhead, thus to secure a stable mounting of the ink cartridge on the carriage. The technique implemented in the embodiments shown in FIGS. 5 through 9 include reinforcement of ink cartridge 11 of the type in which the ink chambers 12*a* to 12*f* are arranged in two arrays, and the viscosities of the various inks are maintained constant. It is evident that the technique is also applicable to the ink cartridge of the single array type shown in FIG. 1.

Figure 10A:
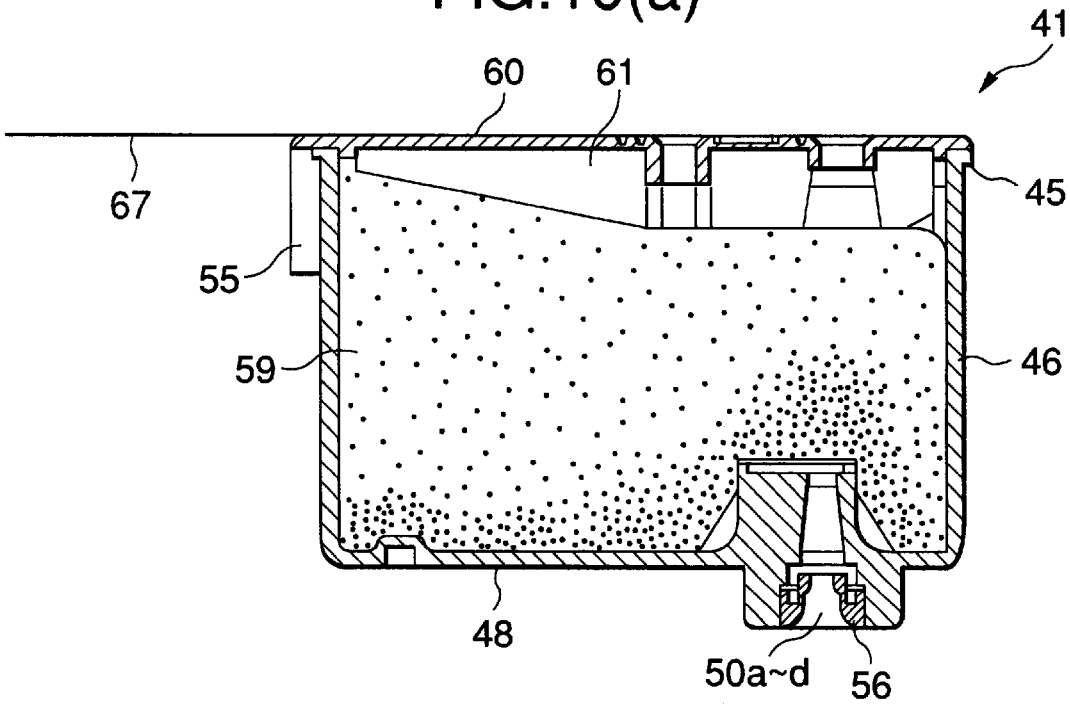
FIG. 10(*b*) is a cross-sectional view of the ink cartridge of FIG. 10(*a*)
Figure 10B:
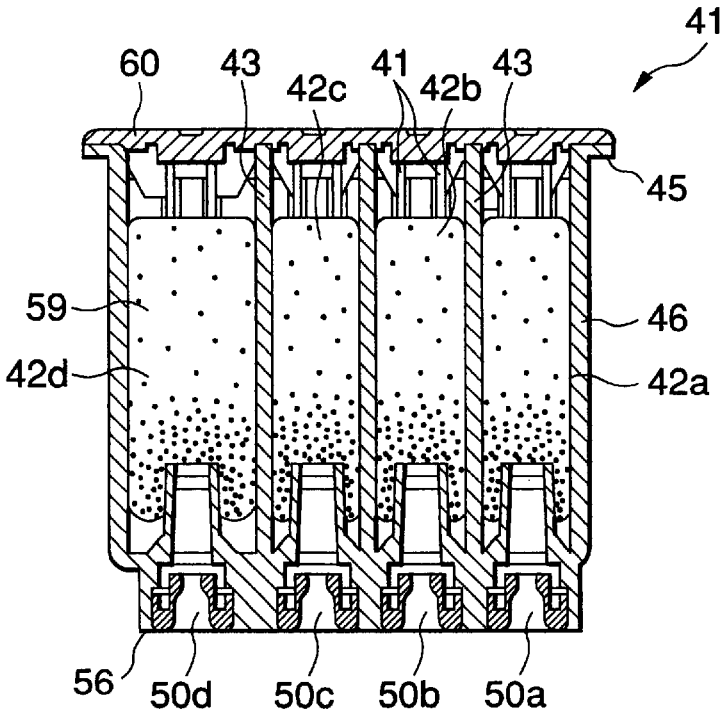
Figure 11A:
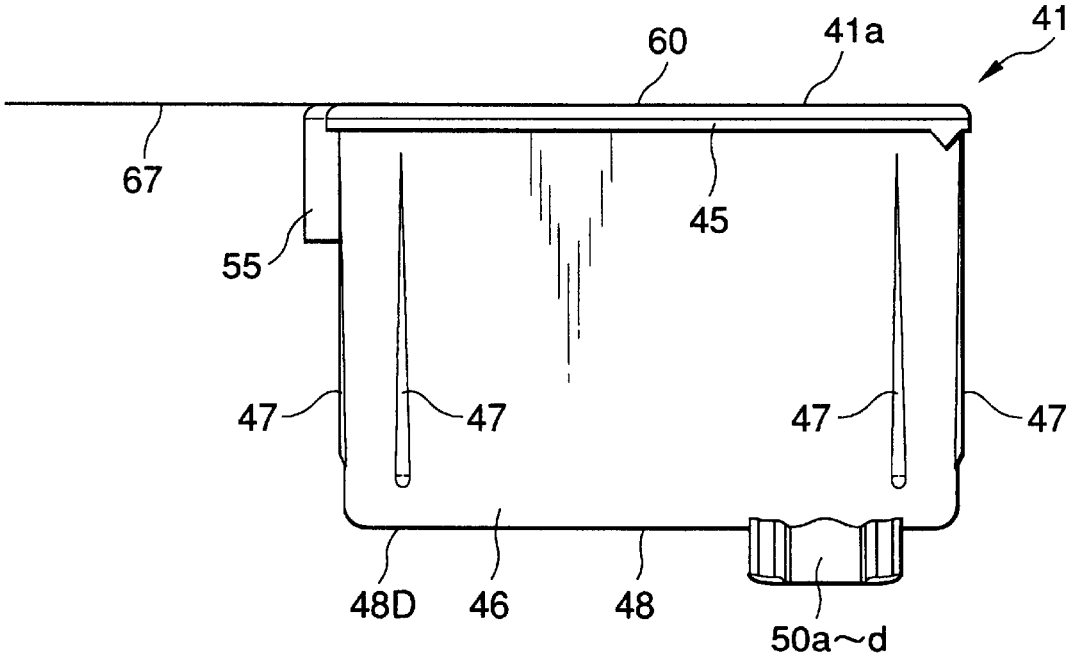
FIG. 11(*a*) is a side elevational view of the ink cartridge shown in FIG. 10(*a*)
Figure 11B:
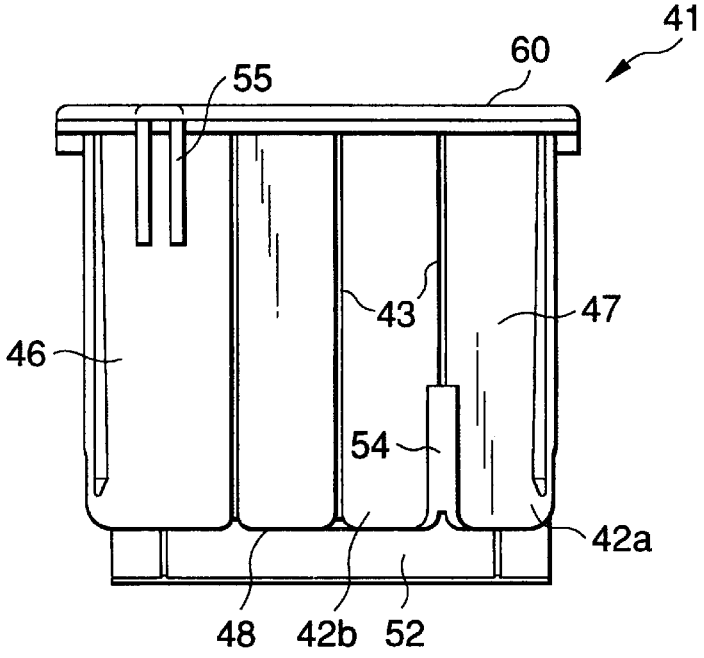
Figure 12A:
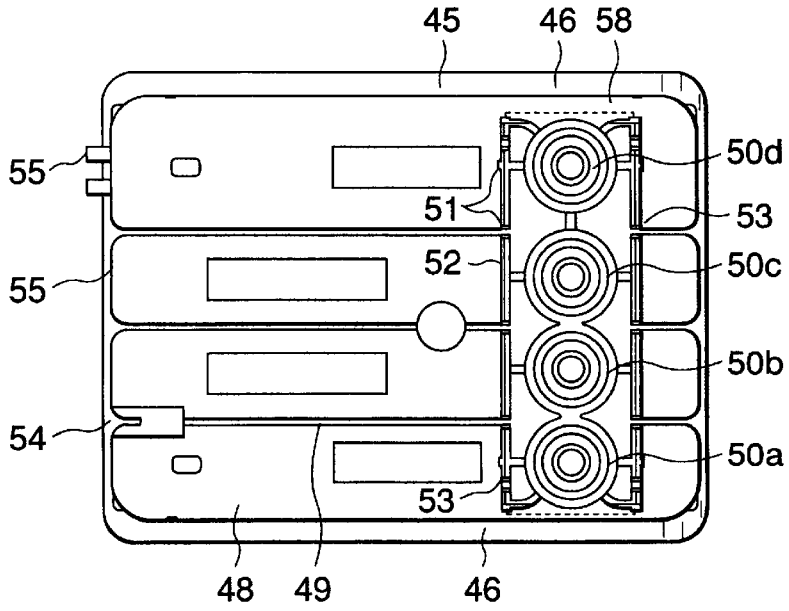
FIG. 12(*a*) is a bottom plan view of the ink cartridge shown in FIG. 10(*a*)
Figure 12B:
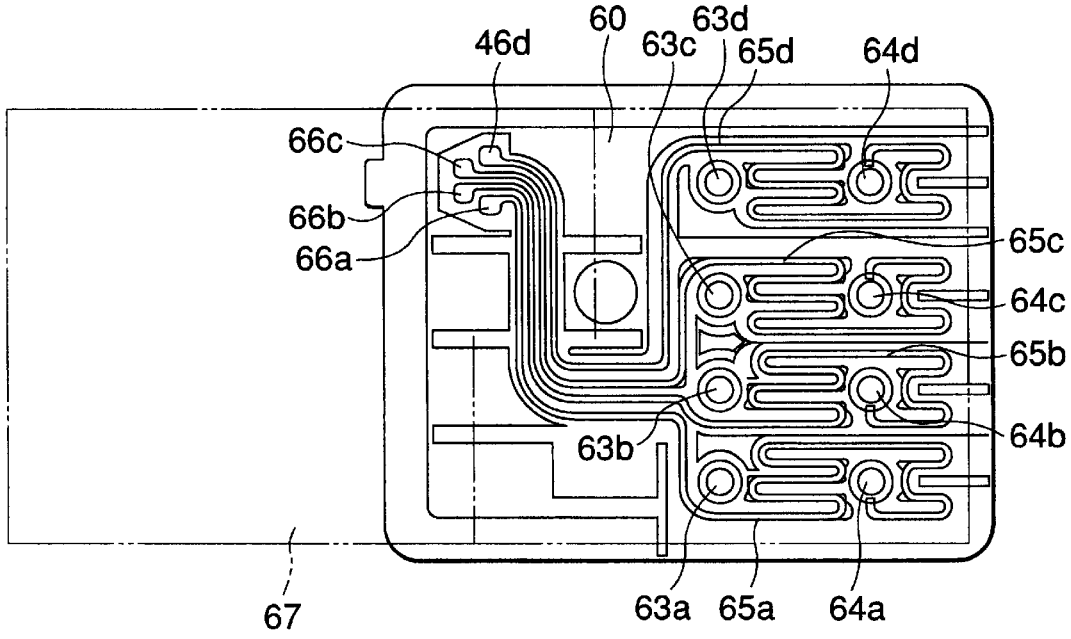

Embodiments shown in FIGS. 10 to 12 include techniques applied to ink cartridges of the single array type.

As is shown in FIGS. 10–12, an ink cartridge indicated generally as 41, is formed with ink chambers 42*a* to 42*c*, which in a preferred embodiment contain inks of magenta, cyan and yellow, and an ink chamber 42*d*, wider than ink chambers 42*a*–42*c*, which in a preferred embodiment contains black ink. Ink chambers 42*a*–42*d* are partitioned from each other by a plurality of partitioning walls 43.

A reinforcing rib 45 extends outwardly from the peripheral edge of open end 41*a* of ink cartridge body 41. The lengthwise dimension of rib 45 is larger than the widthwise dimension thereof so that rib 45 is as strong in the lengthwise direction as it is in the widthwise direction. As shown in FIGS. 11(*a*) and 11(*b*), a rib 47 for receiving a sensor and preventing a deformation of ink cartridge body 41 protrudes from each of the side walls 46 of ink cartridge body 41 while extending vertically along the side wall in FIGS. 11(*a*) and 11(*b*). Each comer connecting the adjacent side walls of the cartridge body is designed such that the thickness of the material forming the comer is uniform over the range from open end 41*a* of ink cartridge body 41 to bottom 480, and the inside and outside radii r and R are gradually reduced from open end 41*a* of ink cartridge body 41 to bottom 480 as in FIGS. 6(*a*) and 6(*b*) of the prior embodiment.

A groove 54 for preventing an incorrect ink cartridge from being attached to a printhead, or for preventing an ink cartridge from being incorrectly mounted to a printhead is formed in one of lengthwise side walls 46, while extending from bottom surface 480 of ink cartridge 41 and extending parallel to partitioning walls 43. An additional raised portion 55 for preventing improper ink tank mounting is formed in the upper portion of side wall 46. The carriage (not shown) is provided with an engaging protrusion formed therein for engaging raised portion 55. When attaching the cartridge to the printhead the protrusion of the carriage is fit to raised portion 55 of ink cartridge 41, to insure the correct attachment of ink cartridge 41 to the printhead.

Bottom walls 48 of ink chambers 42*a* to 42*c* are demarcated with grooves 49 extending parallel to the associated partitioning walls 43. Tubular ink supply ports 50*a* to 50*d* are coupled with one another and project from bottom walls 48 in a linear arrangement.

Frames 52 are positioned on opposing sides of ink supply ports 50*a* to 50*d* along the lengthwise edge of the linear arrangement thereof. Ink supply ports 50*a* to 50*d* are fixed to frames 52 by ribs 51.

Frames 52 extend away from bottom walls 48 a distance slightly greater than the extension of each of ink supply ports 50 and 50*d* away from bottom walls 48 and are located at either end of the ink supply port linear arrangement. A sheet of tape 58 or the like is applied over the linear arrangement of ink supply ports 50*a* to 50*d* and frames 52, whereby these ink supply ports are sealed. Tape 58 is then cut at a position along each of frames 52. Cutouts 53 for air escape are formed at the ridges of the frames 52, allowing for the passage of air and insuring reliable adhesion of tape 58.

As is shown in FIGS. 10*a* and 10*b*, rubber sealing rings 56 are provided to be fit within ink supply ports 50 to 50*d*. When ink supply needles formed of plastic or other appropriate material, which communicate with the printhead, are injected into ink supply ports 50 to 50*d*, the ink supply needles and the ink supply ports are coupled and sealed in an air-tight manner as a result of rubber sealing rings 56.

A cover member 60 is provided for sealing open end 41*a* ink cartridge body 41. As shown in FIGS. 10(*a*) and 10(*b*), ribs 61 are provided on the inner surface of cover member 60 for each of ink chambers 42*a* to 42*c* and extend in a direction into the interior of each ink chamber 42*a* to 42*c* away from cover member 60. Ribs 61 exert a force on each porous members 59 contained in each ink chamber 42*a*–42*d* and aid in compressing each porous member 59.

As is shown in FIG. 12(*b*), ink filling through-holes 63(*a*)–63(*d*) and air escape through-holes 64(*a*)–64(*d*) are formed in a central portion of cover member 61 at a position toward the side of each ink chamber 42*a*–42*d* including ink supply ports 50*a*–50*d* of cover member 60. Circuitous grooves 65(*a*)–65(*d*) are formed in the upper surface of cover member 60 and extend from the associated air escape through-holes 64(*a*)–64(*d*) to exit through-holes 66*a* to 66*d* formed in another portion of the upper surface of cover member 60. Circuitous grooves 65(*a*)–65(*d*) are provided corresponding to each of ink chambers 42*a* to 42*d*. During use, the portion 67*a* of a film 67 covering exit through-holes 66*a*–66*d* is stripped off, exposing ink chambers 42*a* to 42*d* to ambient air through the associated circuitous groove 65(*a*)–65(*d*). The portion of film 67 not removed forms circuitous grooves 65(*a*)–65(*d*) into air passages. The large resistance to fluid flow of each of circuitous grooves 65(*a*)–65(*d*) greatly impedes the evaporation of ink from the ink chambers.

Exit through-holes 66*a* to 66*d* at which circuitous grooves 65(*a*)–65(*d*) terminate are gathered at a location and arrangement to form an array of the through-holes in which the most extended through-holes 66*b* and 66*c* of those through-holes are located at the front of the array when viewed in the direction of stripping film 67*a*. Film 67*a* can easily be stripped off by pulling a portion of the film located at the front of the array.

As seen from the foregoing description, a plurality of ink chambers may be arranged in one or more linear arrays of one surface of an ink cartridge. Therefore, if ink supply ports communicating with the ink chambers are arrayed in a zig-zag or off-set fashion, or the ink chambers, together with ink supply ports, are positioned on opposed sides of the ink chambers, the width of the ink chambers may be reduced independently, and to a size less than of the outside diameters of the ink supplying ports. Thus, ink cartridge of this type used in connection with a full color ink jet printer may be reduced to as small a size as possible. In accordance with the invention, the ink supply ports are formed recessed within the bottom walls of the ink chambers so as to be substantially flush with the open outer ends of the ink supply ports. Therefore, if the shapes of the ink cartridges are substantially the same, the volumes of the ink chambers may be increased to as great an extent as possible. Thus, the frequency of replacing cartridge is reduced, and a more economical ink cartridge is provided.

In accordance with the invention, the air passages communicating with smaller ink chambers housing less ink are longer than air passages communicating with larger ink chambers housing more ink. Thus, the evaporation of ink within the smaller ink chambers which can greatly affect the viscosity of the ink contained therein, is minimized, ensuring stable printing for an extended period of time.

Also in accordance with the invention, a reinforcing rib which has a lengthwise dimension larger a widthwise dimension, is positioned around the opening at the open end of the ink cartridge. Further, another reinforcing rib protrudes from each side wall of the ink cartridge, and extends along the side wall from the open end to the bottom of the ink tank. Thus, even if the ink cartridge is formed as thin as possible using a soft material, so as to be able to contain the largest possible amounts of each of the inks, the ink cartridge has a rigidity high enough to withstand vibrations and variations of acceleration caused during the transportation and movement of the cartridge. Further, the provision of a different groove arrangement for preventing the improper attachment of an ink cartridge. Even if the shapes of all types of ink cartridges are substantially the same irrespective of the type of the printer, only the ink cartridge with the proper groove arrangement can be loaded correctly by engaging the groove arrangement with a counter protrusion arrangement provided on the carriage. The groove may be provided extending along a side wall of the ink tank. Therefore, a continuous, uniform supply of ink is provided. Thus ink tanks can be properly identified and coupled with the correct carriages in a printer.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed:

1. An ink cartridge for a printer; comprising a plurality of ink chambers each having a bottom wall, the bottom walls of said ink chambers collectively defining at least a portion of a bottom wall of said ink cartridge; and a plurality of ink supply ports each positioned to permit the flow of ink from an associated one of said ink chambers, said ink supply ports being arranged in at least two linear arrays on said bottom wall of said ink cartridge, at least two of said ink supply ports being disposed in each of said at least two linear arrays, wherein said linear arrays are generally parallel.

2. The ink cartridge of claim 1, wherein said ink supply ports in one of said linear arrays of said ink supply ports are arrayed in a zig-zag, offset pattern relative to the ink supply ports of another of said linear arrays on said bottom wall of the ink cartridge.

3. The ink cartridge of claim 1, wherein said ink supply ports are arranged in at least two linear arrays on a central portion of said bottom wall of said ink cartridge.

4. The ink cartridge of claim 1, wherein said at least two of said linear arrays of ink supply ports are each arranged adjacent a side edge of said bottom wall of said ink cartridge.

5. An ink cartridge for a printer, comprising:

a plurality of ink chambers, a number of said ink chambers having a volume which is smaller relative to the volume of a number of other of said ink chambers;

a plurality of ink supply ports, an ink supply port being associated with a respective ink chamber;

a cover for sealing said plurality of ink chambers; and a plurality of circuitous air passages being formed integral with said cover, a circuitous air passage being associated with each ink chamber, each of said circuitous air passages placing each associated ink chamber in fluid communication with ambient air, each of said circuitous air passages associated with one of said chambers having said relatively smaller volume having a larger resistance to fluid flow than each of said circuitous air passages associated with one of said other ink chambers having a relatively larger volume.

6. The ink cartridge of claim 5, wherein each of said air passages associated with one of said ink chambers having said relatively smaller volume is longer than each of said air passages associated with one of said other ink chambers having a relatively larger volume.

7. The ink cartridge of claim 5, wherein each of said air passages associated with one of said ink chambers having a relatively smaller volume has a smaller cross-sectional area than each of said air passages associated with one of said other ink chambers having a relatively larger volume.

8. The ink cartridge of claim 5, wherein said cover comprises a cover member having a surface in which are formed circuitous grooves and a sealing member covering at least a portion of said surface of said cover member and said circuitous grooves, said air passages being formed by said circuitous grooves and said sealing member.

9. The ink cartridge of claim 8, wherein said sealing member is formed of a long film having a first portion covering all but an end portion of each of said circuitous grooves, and a second portion which is severable from said first portion and removable during use to place at least an end of each of said circuitous grooves in fluid communication with ambient air.

10. The ink cartridge of claim 5, wherein each of said ink chambers are completely isolated from each other.

11. An ink cartridge comprising:

an integral ink tank formed with a plurality of independent ink chambers each having an interior volume, at least one of said ink chambers being dimensioned so that its interior volume carries less ink than another of said ink chambers, each of said ink chambers having a bottom wall, said ink chamber bottom walls collectively defining at least a portion of a bottom wall of said ink cartridge, and a plurality of ink supply ports formed in said ink chamber bottom walls each positioned to permit the flow of ink from an associated one of said ink chambers, wherein said ink supply ports are arranged on at least two, generally parallel linear arrays, at least two of said ink supply ports being disposed on each of said at least two linear arrays.

12. The ink cartridge of claim 11, and including an ink absorbing member essentially filling each said chamber.

13. An ink cartridge assembly comprising:

a plurality of first ink chambers; and a plurality of first ink supply ports each positioned to permit the flow of ink from an associated one of said first ink chambers, said first ink supply ports being arranged in at least first and second linear arrays, said linear arrays being generally parallel, wherein at least two of said first ink supply ports being arranged on said first linear array; and a second ink chamber disposed adjacent to said plurality of first ink chambers, said second ink chamber comprising:

at least one second ink supply port positioned to permit the flow of ink from said second ink chamber, wherein said second ink supply port is arranged collinearly with one of said first and second linear arrays, wherein a transverse axis passes through said first ink chambers and said second ink chamber, said linear arrays being generally parallel to said transverse axis.

14. The ink cartridge assembly of claim 13, wherein said first ink chambers are integrally formed on a first ink cartridge.

* * * * *